US009299282B2

(12) United States Patent
Oh et al.

(10) Patent No.: US 9,299,282 B2
(45) Date of Patent: Mar. 29, 2016

(54) METHOD OF STORING GAMMA DATA IN A DISPLAY DEVICE, DISPLAY DEVICE AND METHOD OF OPERATING A DISPLAY DEVICE

(71) Applicant: Samsung Display Co., Ltd., Yongin, Gyeonggi-Do (KR)

(72) Inventors: Choon-Yul Oh, Yongin (KR); Gyu-Ho Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 165 days.

(21) Appl. No.: 14/035,793

(22) Filed: Sep. 24, 2013

(65) Prior Publication Data

US 2014/0146090 A1 May 29, 2014

(30) Foreign Application Priority Data

Nov. 23, 2012 (KR) ..... 10-2012-0133433

(51) Int. Cl.
*G09G 5/10* (2006.01)
*G09G 3/20* (2006.01)

(52) U.S. Cl.
CPC ..... *G09G 3/20* (2013.01); *G09G 2320/0276* (2013.01); *G09G 2320/0285* (2013.01); *G09G 2320/0673* (2013.01)

(58) Field of Classification Search
CPC ..... G09G 3/20; G09G 2320/0276; G09G 2320/0285; G09G 2320/0673
USPC ..... 345/76–102, 211, 589, 602, 690; 348/674, E9.054, 739; 358/1.2
See application file for complete search history.

(56) References Cited

U.S. PATENT DOCUMENTS

| | | | | |
|---|---|---|---|---|
| 6,611,249 | B1 * | 8/2003 | Evanicky et al. | 345/102 |
| 6,894,670 | B2 * | 5/2005 | Funakoshi et al. | 345/89 |
| 8,274,399 | B2 * | 9/2012 | Strachan | E21B 44/00 340/853.6 |
| 8,624,942 | B2 * | 1/2014 | Jeon | G09G 3/3208 345/690 |
| 8,947,467 | B2 * | 2/2015 | Yoo et al. | 345/690 |
| 2003/0071923 | A1 * | 4/2003 | Eskin | 348/674 |
| 2003/0098983 | A1 * | 5/2003 | Terada | 358/1.2 |
| 2006/0132415 | A1 * | 6/2006 | Yu | G09G 3/3655 345/98 |
| 2006/0279481 | A1 | 12/2006 | Haruna et al. | |
| 2007/0279433 | A1 * | 12/2007 | Huang | G09G 3/3607 345/601 |
| 2008/0186264 | A1 * | 8/2008 | Lee | G09G 3/3233 345/82 |
| 2009/0015576 | A1 * | 1/2009 | Hu | 345/211 |

(Continued)

FOREIGN PATENT DOCUMENTS

| | | | |
|---|---|---|---|
| JP | 05-064110 | A | 3/1993 |
| KR | 10-2006-0098594 | A | 9/2006 |

*Primary Examiner* — Prabodh M Dharia
(74) *Attorney, Agent, or Firm* — Knobbe, Martens, Olson & Bear, LLP

(57) ABSTRACT

A method of storing gamma data in a display device is disclosed. First, a plurality of gamma curves for a plurality of pixels are provided. One of the plurality of gamma curves is stored as a reference gamma curve in a gamma table included in the display device. Among a plurality of gray levels, a portion of the plurality of gray levels are selected according to a gamma curve characteristic of the display device. With respect to at least one gamma curve of the plurality of gamma curves, differences between the at least one gamma curve and the reference gamma curve at the selected portion of the plurality of gray levels are stored in the gamma table.

20 Claims, 11 Drawing Sheets

(56) References Cited

U.S. PATENT DOCUMENTS

2009/0109156 A1* 4/2009 Hu ..... G02F 1/133555 345/89
2009/0201275 A1* 8/2009 Bae ..... G09G 3/2011 345/208
2010/0001984 A1* 1/2010 Kim ..... G09G 3/3696 345/212
2010/0020094 A1* 1/2010 Park et al. ..... 345/589
2010/0033513 A1* 2/2010 Choi et al. ..... 345/690
2010/0259415 A1* 10/2010 Strachan ..... G05B 13/048 340/853.6
2011/0141414 A1* 6/2011 Furukawa ..... G02F 1/133371 349/113
2011/0273626 A1* 11/2011 Yoo et al. ..... 348/739
2012/0162272 A1* 6/2012 Lee ..... G09G 5/10 345/690
2012/0194572 A1* 8/2012 Saitoh et al. ..... 345/690
2013/0135272 A1* 5/2013 Park ..... G09G 3/3233 345/211
2014/0002479 A1* 1/2014 Muijs ..... G06T 5/50 345/589
2014/0210847 A1* 7/2014 Knibbeler et al. ..... G09G 5/006 345/589

* cited by examiner

FIG. 5

300

| GRAY LEVEL | REFERENCE GAMMA DATA | OFFSET DATA1 | OFFSET DATA2 | ... | OFFSET DATAM | |
|---|---|---|---|---|---|---|
| 1023 | 2676 | | | | | |
| ⋮ | ⋮ | | | | | |
| 877 | 2353 | -148 | -296 | ... | 548 | 313 |
| ⋮ | ⋮ | | | | | |
| 731 | 2089 | | | | | |
| ⋮ | ⋮ | | | | | |
| 585 | 1830 | | | | | |
| ⋮ | ⋮ | | | | | |
| 438 | 1550 | -79 | -164 | ... | 264 | 312 |
| ⋮ | ⋮ | | | | | |
| 292 | 1267 | | | | | |
| ⋮ | ⋮ | | | | | |
| 146 | 991 | | | | | |
| ⋮ | ⋮ | | | | | |
| 73 | 828 | -25 | -63 | ... | 106 | 311 |
| ⋮ | ⋮ | | | | | |

METHOD OF STORING GAMMA DATA IN A DISPLAY DEVICE, DISPLAY DEVICE AND METHOD OF OPERATING A DISPLAY DEVICE

CROSS-REFERENCE TO RELATED APPLICATIONS

This application claims priority under 35 U.S.C. §119 to Korean Patent Application No. 10-2012-0133433 filed on Nov. 23, 2012, the disclosure of which is hereby incorporated by reference herein in its entirety.

BACKGROUND

1. Field

The disclosed technology relates to display devices. More particularly, certain aspects of the disclosed technology relate to methods of storing gamma data in display devices, display devices, and methods of operating display devices.

2. Description of the Related Technology

Generally, a display device has a gamma characteristic that luminance of a displayed image does not increase in linear proportion to a level of an input signal applied to a pixel. To correct the gamma characteristic of the display device, the luminance of the display device according to the input signal level is measured to generate and store gamma data in the display device, and the display device can adjust the input signal based on the stored gamma data to apply the adjusted input signal to the pixel.

In a conventional display device, the gamma data are generated by measuring luminance of one point of a display panel according to the input signal level. However, as form factor size of a display panel increases, the gamma data have to be generated at multiple points of the display panel. If the gamma data at these points are stored, memory capacity for storing the gamma data must increase.

SUMMARY OF CERTAIN INVENTIVE ASPECTS

One aspect includes provide a method of storing gamma data in a display device capable of storing gamma data information of a plurality of positions of a display panel using a small sized gamma table and recovering a gamma curve unique to each display panel.

Another aspect includes a display device capable of storing gamma data information of a plurality of positions of a display panel using a small sized gamma table and recovering a gamma curve unique to each display panel.

Another aspect includes a method of operating a display device capable of storing gamma data information of a plurality of positions of a display panel using a small sized gamma table and recovering a gamma curve unique to each display panel.

According to one aspect of example embodiments, there is a method of storing gamma data in a display device, the method comprising: providing a plurality of gamma curves for a plurality of pixels; storing one of the gamma curves as a reference gamma curve in a gamma table included in the display device; selecting, among a plurality of gray levels, a portion of the gray levels are selected according to a gamma curve characteristic of the display device; and with respect to at least one of the gamma curves, differences between the at least one gamma curve and the reference gamma curve at the selected portion of gray levels are stored in the gamma table.

In example embodiments, the portion of gray levels comprises: selecting the portion of gray levels based on inflection points of the reference gamma curve.

In example embodiments, the portion of gray levels comprises: selecting the portion of gray levels based on a change in slope of the reference gamma curve.

In example embodiments, the at least one gamma curve includes a first gamma curve and a second gamma curve wherein selecting the portion of gray levels comprises: selecting, among the gray levels, first gray levels for the first gamma curve based on inflection points of the first gamma curve or a change in slope of the first gamma curve; and selecting, among the gray levels, second gray levels for the second gamma curve are selected based on inflection points of the second gamma curve or a change in slope of the second gamma curve.

In example embodiments, with respect to the first gamma curve, differences between the first gamma curve and the reference gamma curve comprises: with respect to the second gamma curve, storing differences between the second gamma curve and the reference gamma curve at the second gray levels are stored.

In example embodiments, a gamma curve of a pixel located at a center of a display panel may be stored as the reference gamma curve.

In example embodiments, a middle gamma curve of gamma curves may be stored as the reference gamma curve.

According to another aspect of example embodiments, there is a display device including a display panel, a gamma table, a data converting unit and a driving unit. The display panel includes a plurality of pixels. The pixels include a first pixel having a first gamma curve and a second pixel having a second gamma curve; a gamma table is configured to store gamma data of the first gamma curve at a plurality of gray levels as reference gamma data, and to store offset data corresponding to differences between gamma data of the second gamma curve and the reference gamma data at a portion of the gray levels, the portion of gray levels are selected according to a gamma curve characteristic of the display device; a data converting unit is configured to convert first input data for the first pixel into first gamma corrected data based on the reference gamma data, and to convert second input data for the second pixel into second gamma corrected data based on the reference gamma data and the offset data; and a driving unit is configured to drive the first pixel based on the first gamma corrected data, and to drive the second pixel based on the second gamma corrected data.

In example embodiments, the portion of gray levels is selected based on inflection points of the first gamma curve.

In example embodiments, the portion of gray levels is selected based on a change in slope of the first gamma curve.

In example embodiments, the portion of gray levels is selected based on inflection points of the second gamma curve.

In example embodiments, the portion of gray levels is selected based on a change in slope of the second gamma curve.

In example embodiments, when the second input data indicates one gray level of the portion of gray levels, the data converting unit may generate the second gamma corrected data by calculating a sum of the reference gamma data and the offset data at the one gray level.

In example embodiments, when the second input data indicates one gray level other than the portion of gray levels, the data converting unit may generate the second gamma corrected data by linearly interpolating sums of the reference gamma data and the offset data at the portion of gray levels.

In example embodiments, when third input data for a third pixel is received, the data converting unit generates third gamma corrected data for the third pixel by linearly interpolating the first and second gamma corrected data according to a position of the third pixel.

According to yet another aspect of example embodiments, there is a method of operating a display device. In the method, storing gamma data of a first gamma curve of a first pixel at a plurality of gray levels are stored as reference gamma data; storing offset data corresponding to differences between gamma data of a second gamma curve of a second pixel and the reference gamma data at a portion of the gray levels, the portion of gray levels are selected according to a gamma curve characteristic of the display device; converting first input data for the first pixel into first gamma corrected data based on the reference gamma data; Converting second input data for the second pixel into second gamma corrected data based on the reference gamma data and the offset data; and driving the first pixel and the second pixel based on the first gamma corrected data and the second gamma corrected data, respectively.

In example embodiments, the portion of gray levels is selected based on inflection points of the first gamma curve or a change in slope of the first gamma curve.

In example embodiments, the portion of gray levels is selected based on inflection points of the second gamma curve or a change in slope of the second gamma curve.

In example embodiments, when the second input data indicates one gray level of the portion of gray levels, the second gamma corrected data may be generated by calculating a sum of the reference gamma data and the offset data at the one gray level.

In example embodiments, when the second input data indicates one gray level other than the portion of gray levels, the second gamma corrected data may be generated by linearly interpolating sums of the reference gamma data and the offset data at the portion of gray levels.

BRIEF DESCRIPTION OF THE DRAWINGS

Example embodiments can be understood in more detail from the following description taken in conjunction with the accompanying drawings, in which:

FIG. 5 is a diagram illustrating an example of a gamma table;

DETAILED DESCRIPTION OF CERTAIN INVENTIVE EMBODIMENTS

Figure 1:
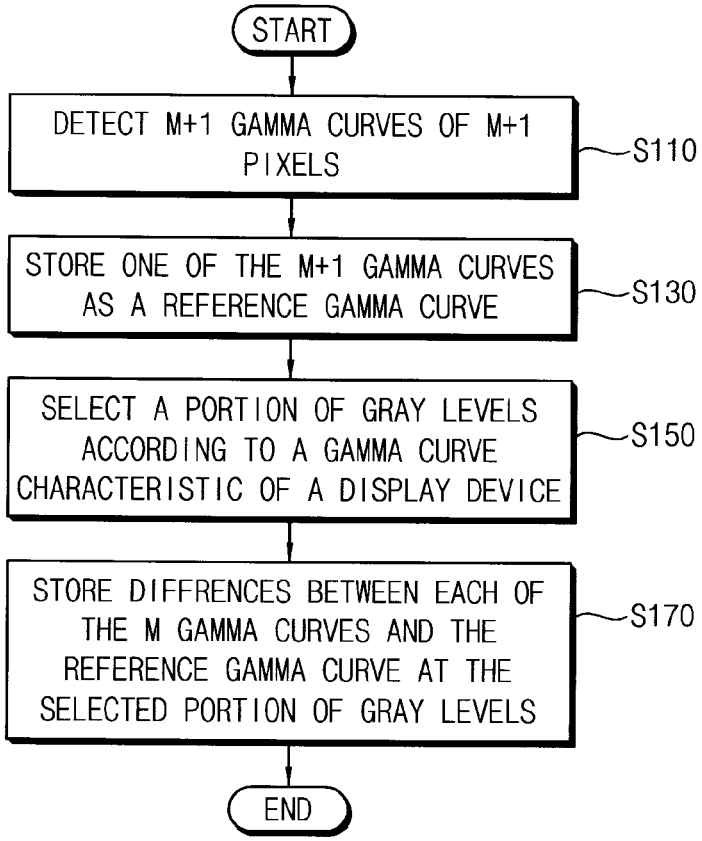
FIG. 1 is a flowchart illustrating a method of storing gamma data in a display device in accordance with example embodiments.

The example embodiments are described more fully hereinafter with reference to the accompanying drawings. The disclosed technology may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the disclosed technology. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
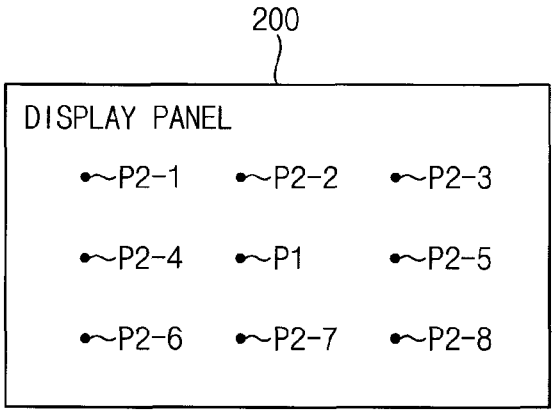
FIG. 2 is a diagram for describing an example of a reference gamma curve.
Figure 3:
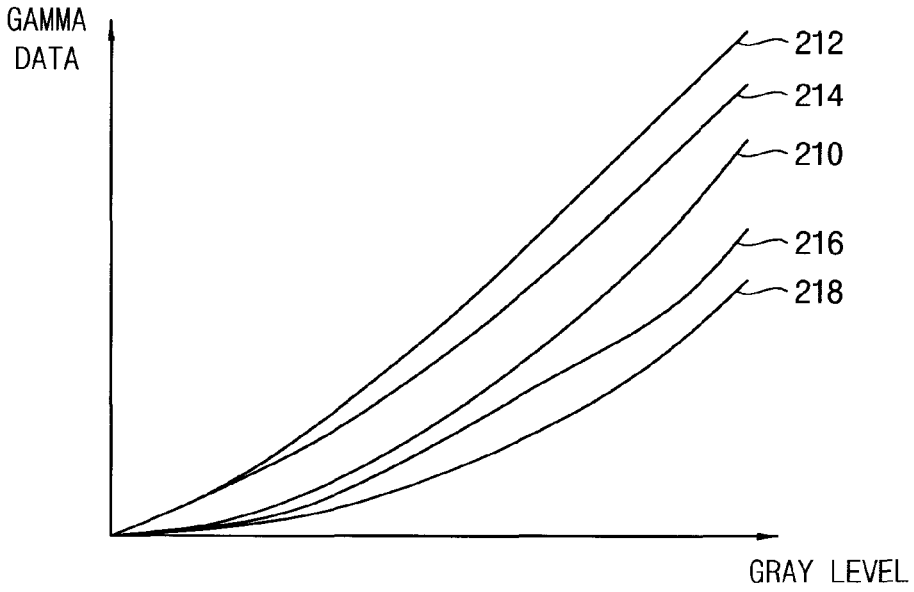
FIG. 3 is a diagram for describing another example of a reference gamma curve.
Figure 4:
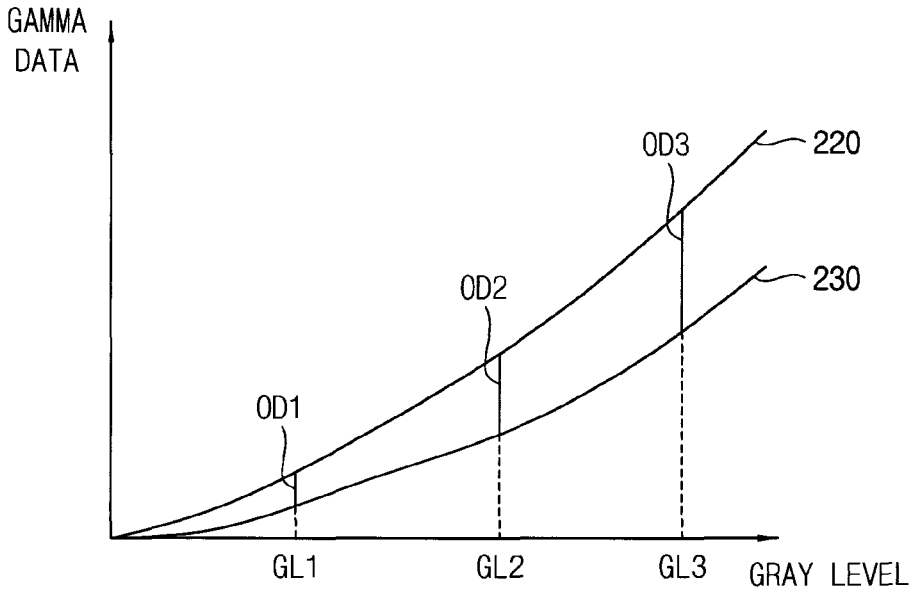
FIG. 4 is a diagram for describing an example of offset data.

FIG. 1 is a flowchart illustrating a method of storing gamma data in a display device in accordance with example embodiments, FIG. 2 is a diagram for describing an example of a reference gamma curve, FIG. 3 is a diagram for describing another example of a reference gamma curve, FIG. 4 is a diagram for describing an example of offset data, and FIG. 5 is a diagram illustrating an example of a gamma table.

Referring to FIG. 1, in a method of storing gamma data in a display device according to example embodiments, M+1 gamma curves of M+1 pixels among a plurality of pixels included in the display device are detected (S110), where M is an integer greater than 0. For example, after the display device is manufactured, test equipment may detect the M+1 gamma curves suitable for the M+1 pixels by measuring luminance of the M+1 pixels according to an applied voltage. In some example embodiments, the M+1 pixels of which the M+1 gamma curves are detected may be arranged in a matrix form, and may be spaced apart from each other by a first predetermined interval in a row direction and by a second predetermined interval in a column direction.

One of the M+1 gamma curves is stored as a reference gamma curve (S130). For example, the test equipment may determine one of the M+1 gamma curves as the reference gamma curve, and may store reference gamma data of the reference gamma curve in a gamma table included in the display device.

In some example embodiments, a gamma curve of a pixel having a predetermined position among the M+1 pixels may be determined as the reference gamma curve. For example, as illustrated in FIG. 2, among 9 pixels P1, P2-1, P2-2, P2-3, P2-4, P2-5, P2-6, P2-7 and P2-8 arranged in a matrix form, a gamma curve of a pixel P1 located at the center of a display panel 200 may be determined as the reference gamma curve. Although an example where the gamma curve of the pixel P1 located at the center is determined as the reference gamma curve is illustrated in FIG. 2, according to example embodiments, a gamma curve of a pixel having any position among the M+1 pixels may be determined as the reference gamma curve. For example, a gamma curve of a pixel P2-1 located at a top-left position among the M+1 pixels may be determined as the reference gamma curve. Further, although an example where nine gamma curves of nine pixels P1, P2-1, P2-2, P2-3, P2-4, P2-5, P2-6, P2-7 and P2-8 are detected is illustrated in FIG. 2, according to example embodiments, two or more gamma curves of two or more pixels may be detected.

In other example embodiments, a middle gamma curve of the plurality of gamma curves functions as the reference gamma curve. For example, as illustrated in FIG. 3, in a case where five gamma curves 210, 212, 214, 216 and 218 are detected, a middle gamma curve 210 having gamma data having middle values, namely, not being at one of the extremes, among the five gamma curves 210, 212, 214, 216 and 218 may be determined as the reference gamma curve. If the middle gamma curve 210 is determined as the reference gamma curve, differences between the middle gamma curve 210 and the other gamma curves 212, 214, 216 and 218, or offset data of the other gamma curves 212, 214, 216 and 218 may be minimized, and thus the size of the gamma table can be minimized.

Among a plurality of gray levels, a portion of the plurality of gray levels are selected according to a gamma curve characteristic of the display device (S150). In some example embodiments, the portion of the plurality of gray levels may be selected based on the reference gamma curve. For example, gray levels corresponding to inflection points of the reference gamma curve may be selected as the portion of the plurality of gray levels. In another example, gray levels corresponding to points where changes in slope of the reference gamma curve (e.g., a difference between a slope of the reference gamma curve at the previous gray level and a slope of the reference gamma curve at the current gray level, or a difference between a slope of the reference gamma curve at the current gray level and a slope of the reference gamma curve at the next gray level) are relatively large may be selected as the portion of the plurality of gray levels. In the same display device, the M+1 gamma curves may have similar characteristics (e.g., similar slopes), and thus, although the portion of the plurality of gray levels are selected based on the reference gamma curve, the portion of the plurality of gray levels may substantially correspond to inflection points of the other gamma curves or points of the other gamma curves where changes in slope are relatively large.

In other example embodiments, with respect to each of the M gamma curves except for the reference gamma curve among the M+1 gamma curves, the portion of the plurality of gray levels may be selected per each of the M gamma curves based on each of the M gamma curves. For example, in a case where the M+1 gamma curves include a first gamma curve, a second gamma curve and the reference gamma curve, first gray levels for the first gamma curve may be selected based on inflection points of the first gamma curve or a change in slope of the first gamma curve, and second gray levels for the second gamma curve may be selected based on inflection points of the second gamma curve or a change in slope of the second gamma curve. In this case, offset data of the first gamma curve at the first gray levels (i.e., differences between the first gamma curve and the reference gamma curve at the first gray levels) may be stored in the gamma table with respect to the first gamma curve, and offset data of the second gamma curve at the second gray levels (i.e., differences between the second gamma curve and the reference gamma curve at the second gray levels) may be stored in the gamma table with respect to the second gamma curve. Thus, offset data of the M gamma curves at different gray levels may be stored in the gamma table with respect to the M gamma curves.

Differences between each of the M gamma curves and the reference gamma curve at the selected portion of the plurality of gray levels are stored with respect to the respective M gamma curves (S170). That is, offset data of the each of the M gamma curves at the selected portion of the plurality of gray levels may be stored in the gamma table with respect to the respective M gamma curves. For example, as illustrated in FIG. 4, in a case where a first gray level GL1, a second gray level GL2 and a third gray level GL3 are selected, a difference OD1 between a gamma curve 230 and a reference gamma curve 220 at the first gray level GL1, a difference OD2 between the gamma curve 230 and the reference gamma curve 220 at the second gray level GL2, and a difference OD3 between the gamma curve 230 and the reference gamma curve 220 at the third gray level GL3 may be stored as offset data OD1, OD2 and OD3 of the gamma curve 230 in the gamma table.

FIG. 5 illustrates an example of the gamma table 300 where gamma data are stored according to the method of storing the gamma data illustrated in FIG. 1. Referring to FIG. 5, reference gamma data of the reference gamma curve may be stored in the gamma table 300. The reference gamma data may include gamma data of the reference gamma curve at the entire set of gray levels (e.g., 0 gray level to 1023 gray level). Further, offset data of the M gamma curves at a portion of gray levels may be stored in the gamma table 300. For example, a difference between each of the M gamma curves and the reference gamma curve at gray level 73 may be stored in the gamma table 300 as illustrated in a first row 311, a difference between each of the M gamma curves and the reference gamma curve at gray level 438 may be stored in the gamma table 300 as illustrated in a second row 312, and a difference between each of the M gamma curves and the reference gamma curve at gray level 877 may be stored in the gamma table 300 as illustrated in a third row 313.

Display devices will typically have a variety of different gamma curve characteristics. Accordingly, if gray levels at which offset data are stored are fixed, the M gamma curves of the display device may not be recovered in their original form since a gamma curve characteristic of the display device is not considered. However, in the method of storing the gamma data according to example embodiments, the gray levels at which the offset data are stored (e.g., gray levels 73, 438 and 877 in FIG. 5) are selected according to the gamma curve characteristic (e.g., an inflection point, a slope, a change in slope, etc. of the reference gamma curve or each of the M gamma curves) of each display device. Accordingly, in the display device according to example embodiments, the M gamma curves may be accurately recovered based on the offset data at the gray levels that are selected according to the gamma curve characteristic of the display device.

As described above, in the method of storing the gamma data according to example embodiments, gamma data of one of the M+1 gamma curves at the entire gray levels may be stored as reference gamma data, and offset data corresponding to differences between gamma data of each of the other M gamma curves and the reference gamma data at the portion of gray levels may be stored. Accordingly, the gamma table 300 will have a relatively small size compared to storing data from multiple curves. Further, the portion of gray levels at which the offset data of the M gamma curves are stored may be selected according to a gamma curve characteristic (e.g., an inflection point, a slope, a change in slope, etc. of the reference gamma curve or each of the M gamma curves) of the display device. Accordingly, the display device according to example embodiments may accurately recover the M gamma curves based on the offset data at the gray levels that are selected according to the gamma curve characteristic of the display device.

Further, in the method of storing the gamma data according to example embodiments, the number (i.e., M+1) of pixels for which the reference gamma data or the offset data are stored may range from 2 to the number of the entire pixels included in the display panel. For example, in a case where the display device includes N pixels, the number of pixels for which the reference gamma data or the offset data are stored may range from 2 to N, where N is an integer greater than 1. In the display device including N pixels, although the reference gamma data or the offset data for the N pixels, or the entire set of pixels is stored, the display device may accurately recover gamma curves of the entire pixel set using a small sized gamma table since gamma data for a portion of the pixels (e.g., one pixel) at the entire gray levels are stored as the reference gamma data, and the offset data for the other pixels at the selected portion of gray levels are stored. In the case where the reference gamma data or the offset data for the entire pixels are stored, Mura or spots having a high frequency may be compensated. According to example embodiments, the number of pixels for which the reference gamma data or the offset data are stored may be selected according to a display characteristic.

Figure 6:
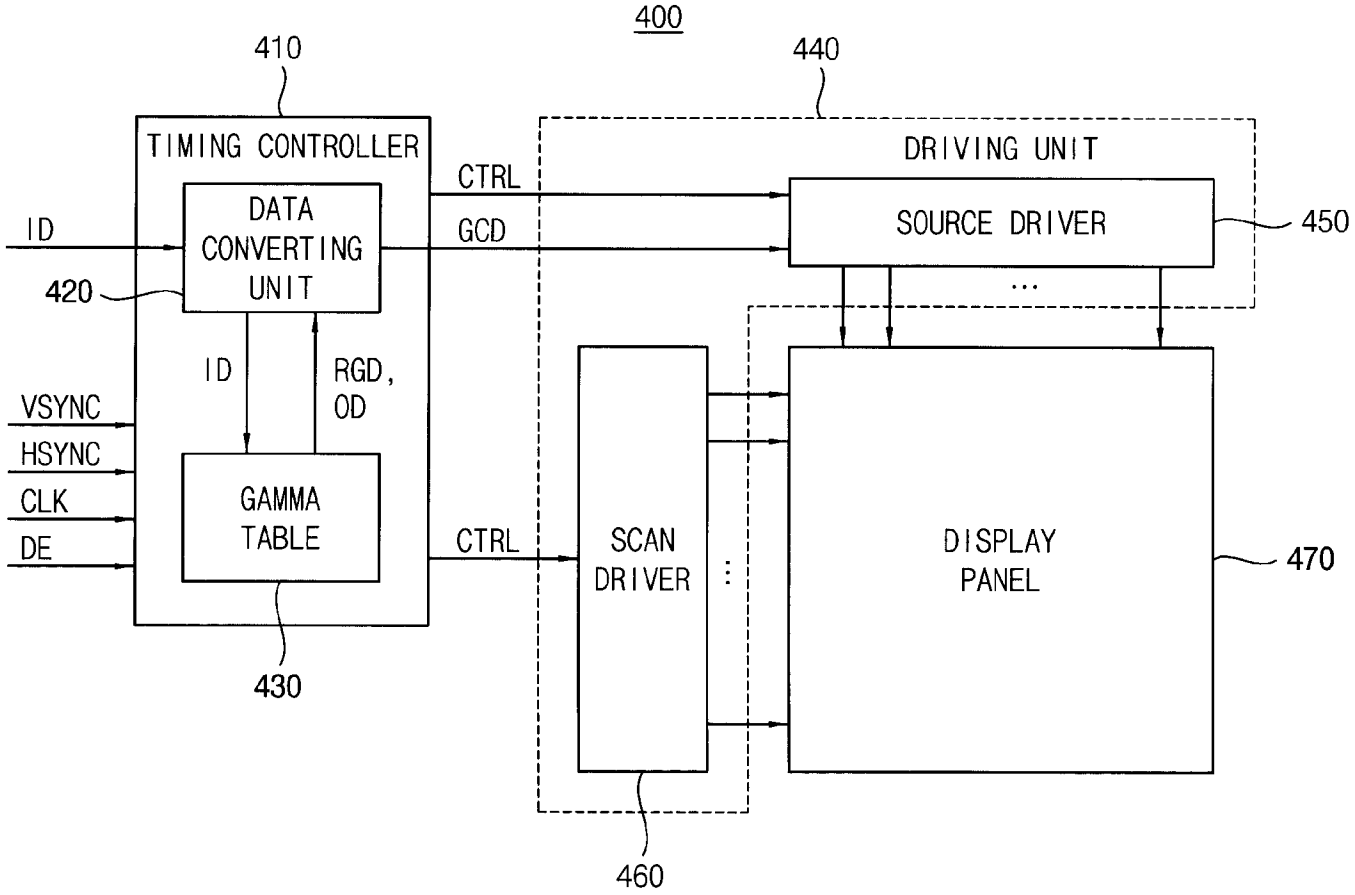
FIG. 6 is a block diagram illustrating a display device in accordance with example embodiments.

FIG. 6 is a block diagram illustrating a display device in accordance with example embodiments.

Referring to FIG. 6, a display device 400 includes a timing controller 410, a driving unit 440 and a display panel 470.

The example display panel 470 includes a plurality of pixels arranged in a matrix form having a plurality of rows and a plurality of columns. According to example embodiments, the display panel 470 can be any suitable display panel, such as a liquid crystal display (LCD) panel, an organic light emitting diode (OLED) panel, a plasma display panel (PDP), a field emission display (FED) panel, etc.

The timing controller 410 receives input data ID and control signals VSYNC, HSYNC, CLK and DE from a host device. For example, the control signals VSYNC, HSYNC, CLK and DE include a vertical synchronization signal VSYNC, a horizontal synchronization signal HSYNC, a clock signal CLK and a data enable signal DE. The timing controller 410 generates gamma corrected data GCD and a control signal CTRL provided to the driving unit 440 based on the input data ID and the control signals VSYNC, HSYNC, CLK and DE. The timing controller 410 includes a data converting unit 420 and a gamma table 430.

The gamma table 430 stores gamma data of a first gamma curve of a first pixel included in the display panel 470 as reference gamma data RGD. For example, the gamma table 430 may store the gamma data of the first gamma curve at the entire gray levels as the reference gamma data RGD. Since the gamma data of the first gamma curve at the entire set of gray levels is stored, the display device 400 can recover the first gamma curve as it is. According to example embodiments, gamma data of a gamma curve of a pixel located at a predetermined position (e.g., the center) of the display panel 470 may be stored as the reference gamma data RGD, or gamma data of a middle gamma curve among gamma curves detected by a test equipment may be stored as the reference gamma data RGD.

The gamma table 430 may further store offset data OD of a second gamma curve of at least one second pixel included in the display panel 470. The offset data OD may correspond to differences between gamma data of the second gamma curve and the reference gamma data RGD. The gamma table 430 may store the offset data OD at a portion of the entire gray levels. Since the gamma data of the second gamma curve are not stored as it is, and the offset data OD, or the differences between the gamma data and the reference gamma data RGD are stored, the gamma table 430 may have a small size. Further, since the offset data OD are not stored at the entire gray levels, and the offset data OD are stored at the portion of gray levels, the gamma table 430 may have a smaller size.

Even if display devices are of the same model, the display devices may have difference gamma curve characteristics. Thus, in a case where the display devices of the same model store the offset data OD at the fixed gray levels, the second gamma curve recovered based on the offset data OD may be different from an actual second gamma curve in at least some display devices.

However, in the display device 400 according to example embodiments, the portion of gray levels at which the offset data OD are stored may be selected according to a gamma curve characteristic (e.g., an inflection point, a slope, a change in slope, etc. of the first gamma curve or the second gamma curve) of each display device 400. For example, in the display device 400, gray levels corresponding to inflection points of the first gamma curve or the second gamma curve may be selected as the portion of gray levels at which the offset data OD are stored, or gray levels corresponding to points where changes in slope of the first gamma curve or the second gamma curve are relatively large may be selected as the portion of gray levels at which the offset data OD are stored. As described above, since the portion of gray levels at which the offset data OD are stored are selected according to the gamma curve characteristic of each display device 400, gamma data at the other gray levels calculated by interpolating (e.g., linearly interpolating) gamma data at the portion of gray levels may be substantially the same as gamma data of the real second gamma curve. That is, the display device 400 may accurately recover the second gamma curve based on the offset data OD at the portion of gray levels selected according to the gamma curve characteristic.

In some example embodiments, the gamma table 430 may be implemented with a look-up table (LUT). Although FIG. 6 illustrates an example where the gamma table 430 is located inside the timing controller 410, according to example embodiments, the gamma table 430 may be located outside the timing controller 410.

The data converting unit 420 may convert the input data ID into the gamma corrected data GCD by using the gamma table 430. For example, the data converting unit 420 may provide the input data ID to the gamma table 430, and may receive the reference gamma data RGD and/or the offset data OD corresponding to the input data ID from the gamma table 430. The data converting unit 420 may generate the gamma corrected data GCD corresponding to the input data ID based on the received reference gamma data RGD and/or the received offset data OD.

For example, the data converting unit 420 may convert first input data ID for the first pixel into first gamma corrected data GCD based on the reference gamma data RGD. That is, when the first input data ID for the first pixel indicates a gray level, the data converting unit 420 may receive the reference gamma data RGD at the gray level from the gamma table 430, and may output the reference gamma data RGD at the gray level as the first gamma corrected data GCD.

Further, the data converting unit 420 may convert second input data ID for the second pixel into second gamma corrected data GCD based on the reference gamma data RGD and the offset data OD. When the second input data ID indicates one of the portion of gray levels at which the offset data OD are stored, the data converting unit 420 may receive the reference gamma data RGD and the offset data OD at the one of the portion of gray levels, and may output a sum of the reference gamma data RGD and the offset data OD at the one of the portion of gray levels as the second gamma corrected data GCD. When the second input data ID indicates one gray level other than the portion of gray levels at which the offset data OD are stored, the data converting unit 420 may receive the reference gamma data RGD and the offset data OD at two or more of the portion of gray levels (e.g., at a gray level higher than the one gray level and at a gray level lower than the one gray level), and may generate the second gamma corrected data GCD by interpolating (e.g., linearly interpolating) at least two sums of the reference gamma data RGD and the offset data OD at two or more of the portion of gray levels.

Further, when the data converting unit 420 receives third input data ID for a third pixel for which neither the reference gamma data RGD nor the offset data OD are stored, the data converting unit 420 may generate third gamma corrected data GCD for the third pixel by linearly interpolating the first and second gamma corrected data GCD for the first and second pixels for which the reference gamma data RGD or the offset data OD are stored according to a position of the third pixel. For example, the data converting unit 420 may calculate the gamma corrected data GCD for adjacent pixels for which the reference gamma data RGD or the offset data OD are stored, and may generate the third gamma corrected data GCD by performing horizontal interpolation and/or vertical interpolation on the gamma corrected data GCD for the adjacent pixels.

The driving unit 440 may be controlled by the timing controller 410 to drive the display panel 470. The driving unit 440 may drive the first pixel based on the first gamma corrected data GCD provided from the timing controller 410, and may drive the second pixel based on the second gamma corrected data GCD provided from the timing controller 410. For example, the driving unit 440 may apply a voltage (or current) having a level corresponding to the first gamma corrected data GCD to the first pixel, and may apply a voltage (or current) having a level corresponding to the second gamma corrected data GCD to the second pixel. In some example embodiments, the driving unit 440 may include a scan driver 460 for turning on or offs thin film transistors formed on the display panel 470, and a source driver 450 for applying voltages (or currents) having levels corresponding to the gamma corrected data GCD provided from the timing controller 410 to the display panel 450.

As described above, the display device 400 according to example embodiments may store the reference gamma data RGD with respect to one position (or one pixel) in the display panel 470, and may store the offset data OD with respect to other positions. Accordingly, the display device 400 may store gamma data information for a plurality of positions by using the small sized gamma table 430. Further, the display device 400 according to example embodiments may select gray levels at which the offset data OD are stored according to a gamma curve characteristic of each display device 400, thereby accurately recover gamma curves that are unique to each display device 400.

Figure 7:
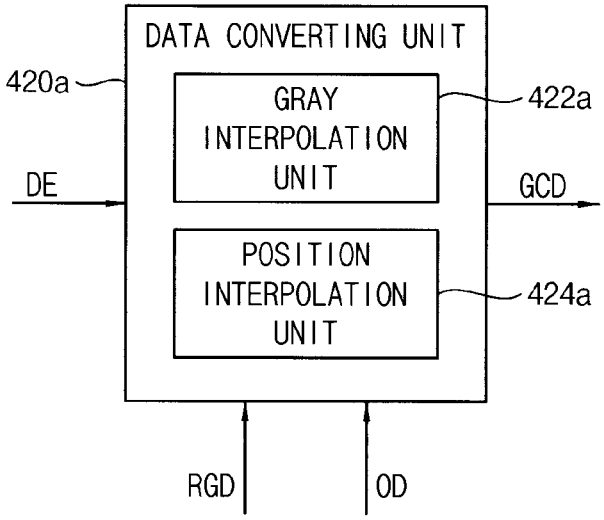
FIG. 7 is a block diagram illustrating an example of a data converting unit included in a display device of FIG. 6.
Figure 8:
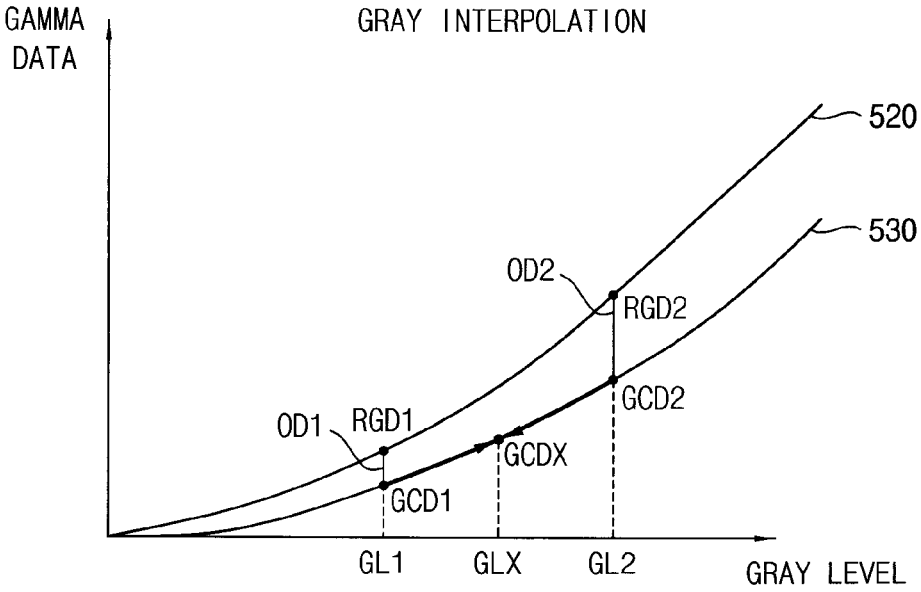
FIG. 8 is a diagram for describing an example of gray interpolation performed by a data converting unit of FIG. 7.
Figure 9:
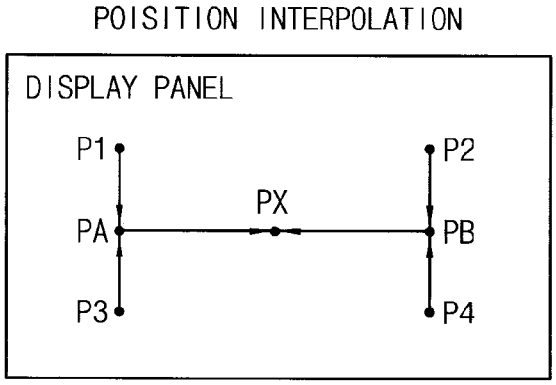
FIG. 9 is a diagram for describing an example of position interpolation performed by a data converting unit of FIG. 7.
Figure 10:
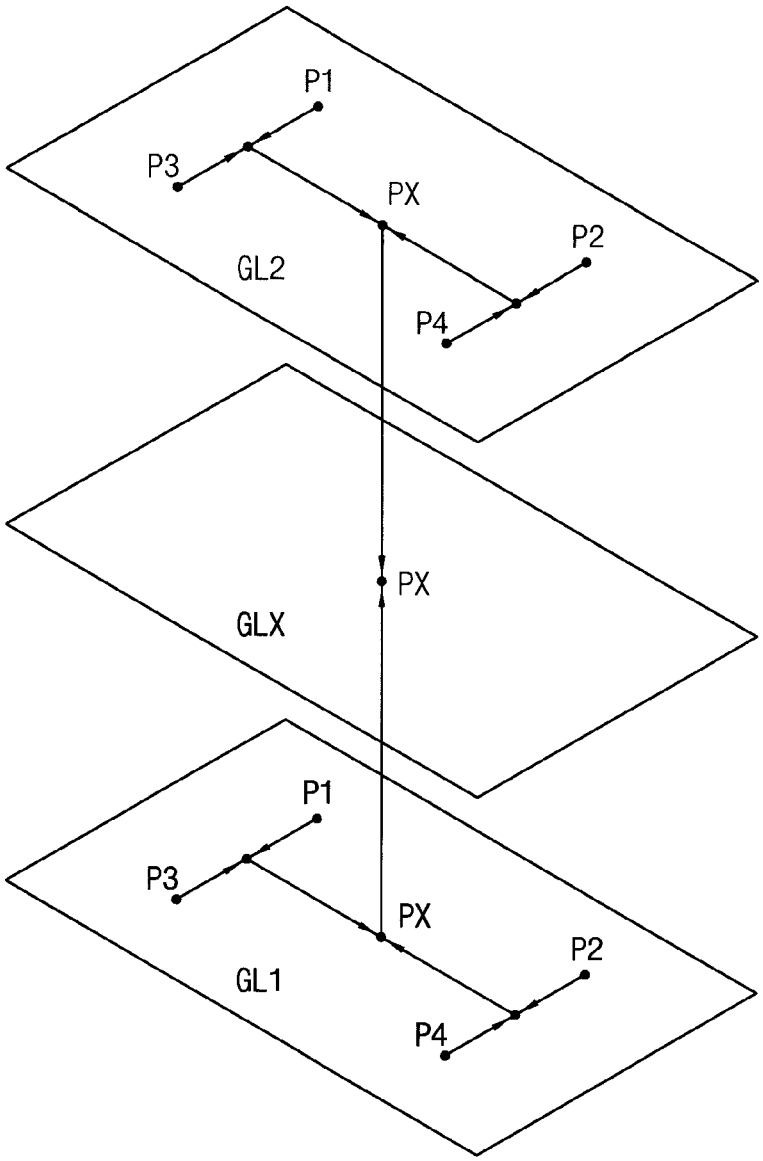
FIG. 10 is a diagram for describing an example of gray and position interpolations performed by a data converting unit of FIG. 7.
Figure 11:
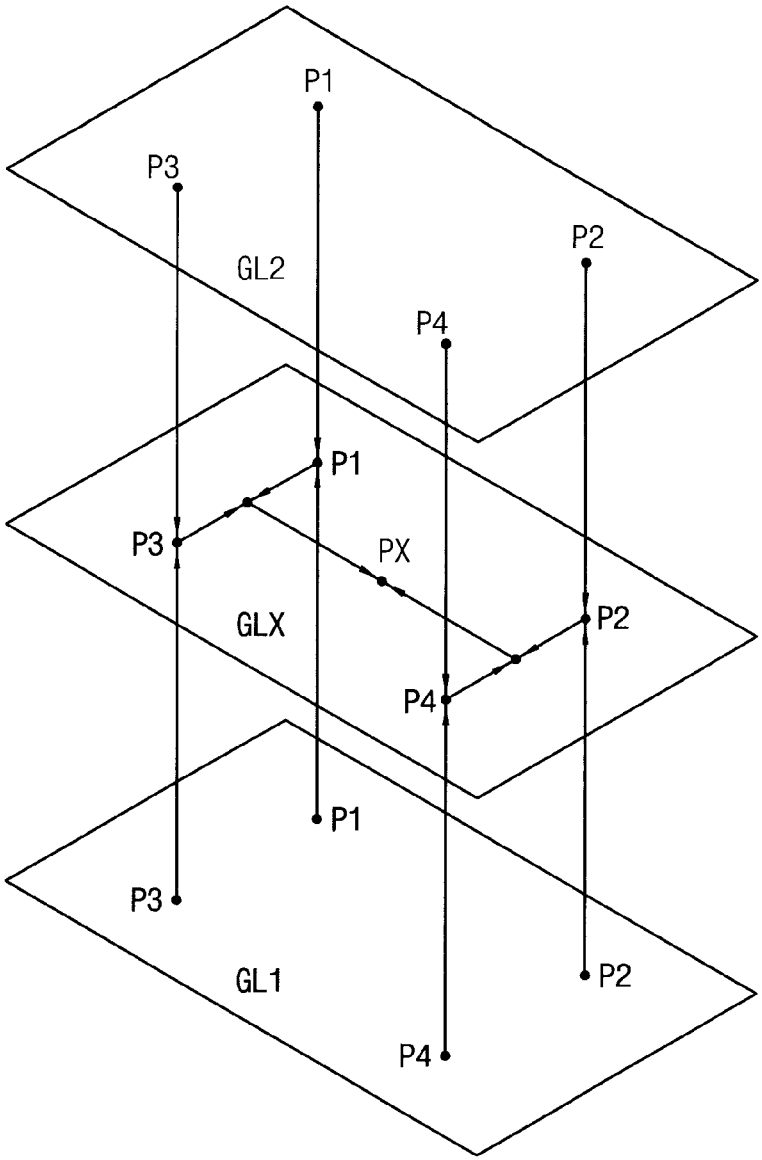
FIG. 11 is a diagram for describing another example of gray and position interpolations performed by a data converting unit of FIG. 7.

FIG. 7 is a block diagram illustrating an example of a data converting unit included in a display device of FIG. 6, FIG. 8 is a diagram for describing an example of gray interpolation performed by a data converting unit of FIG. 7, FIG. 9 is a diagram for describing an example of position interpolation performed by a data converting unit of FIG. 7, FIG. 10 is a diagram for describing an example of gray and position interpolations performed by a data converting unit of FIG. 7, and FIG. 11 is a diagram for describing another example of gray and position interpolations performed by a data converting unit of FIG. 7.

Referring to FIG. 7, a data converting unit 420*a* may include a gray interpolation unit 422*a* and a position interpolation unit 424*a*.

When the data converting unit 420*a* receives input data ID for a first pixel for which reference gamma data RGD are stored, the data converting unit 420*a* may output the reference gamma data RGD as gamma corrected data GCD. Further, when the data converting unit 420*a* receives input data ID for a second pixel for which offset data OD are stored, and the input data ID indicates a gray level at which the offset data OD are stored, the data converting unit 420*a* may output a sum of the reference gamma data RGD at the gray level and the offset data OD at the gray level as the gamma corrected data GCD.

When the data converting unit 420*a* receives input data ID for the second pixel, and the input data ID indicates a gray level at which the offset data OD are not stored, the data converting unit 420*a* may generate the gamma corrected data GCD by interpolating (e.g., linearly interpolating) sums of the reference gamma data RGD and the offset data OD at gray levels at which the offset data OD are stored using the gray interpolation unit 422*a*.

For example, as illustrated in FIG. 8, in a case where the data converting unit 420*a* receives the input data ID for the second pixel for which the offset data OD1 and OD2 are stored, and the input data ID indicates a gray level GLX at which the offset data OD1 and OD2 are not stored, the data converting unit 420*a* may calculate first and second gamma corrected data GCD1 and GCD2 at first and second gray levels GL1 and GL2 at which first and second offset data OD1 and OD2 are stored. For example, the data converting unit 420*a* may calculate the first gamma corrected data GCD1 by adding the first reference gamma data RGD1 and the first offset data OD1 at the first gray level GL1, and may calculate the second gamma corrected data GCD2 by adding the second reference gamma data RGD2 and the second offset data OD2 at the second gray level GL2. The gray interpolation unit 422*a* may generate the gamma corrected data GCD corresponding to the input data OD by linearly interpolating the first gamma corrected data GCD 1 and the second gamma corrected data GCD2 according to an interval between the gray level GLX and the first gray level GL1 and an interval between the gray level GLX and the second gray level GL2.

Further, when the data converting unit 420*a* receives the input data ID for a third pixel for which neither the reference gamma data RGD nor the offset data OD are stored, and the input data ID indicates a gray level (e.g., gray level 73, gray level 438 or 877 gray level illustrated in FIG. 5) at which the offset data OD are stored, the data converting unit 420*a* may generate the gamma corrected data GCD by interpolating (e.g., linearly interpolating) the gamma corrected data GCD for pixels for which the reference gamma data RGD or the offset data OD are stored according to distances of the third pixel to the pixels using the position interpolation unit 424*a*.

For example, as illustrated in FIG. 9, in a case where the data converting unit 420*a* receives the input data ID for a pixel PX for which neither the reference gamma data RGD nor the offset data OD are stored, the data converting unit 420*a* may calculate first through fourth gamma corrected data for four pixels P1, P2, P3 and P4 for which the reference gamma data RGD or the offset data OD are stored, and the four pixels P1, P2, P3 and P4 may be located at four vertices of a virtual block where the pixel PX is located. The position interpolation unit 424*a* may generate the gamma corrected data GCD corresponding to the input data ID by linearly interpolating the first through fourth gamma corrected data of the four pixels P1, P2, P3 and P4. For example, the position interpolation unit 424*a* may calculate fifth gamma corrected data for a pixel PA located at the left of the pixel PX on a horizontal line where the pixel PX is located by linearly interpolating the first gamma corrected data of the pixel P1 located at the top-left vertex and the third gamma corrected data of the pixel P3 located at the bottom-left vertex in a vertical direction, and may calculate sixth gamma corrected data for a pixel PB located at the right of the pixel PX on the horizontal line by linearly interpolating the second gamma corrected data of the pixel P2 located at the top-right vertex and the fourth gamma corrected data of the pixel P4 located at the bottom-right vertex in a vertical direction. Further, the position interpolation unit 424*a* may generate the gamma corrected data GCD corresponding to the input data ID of the pixel PX by linearly interpolating the fifth gamma corrected data of the pixel PA at the left and the sixth gamma corrected data of the pixel PB at the right in a horizontal direction.

Further, when the data converting unit 420*a* receives the input data ID for the third pixel for which neither the reference gamma data RGD nor the offset data OD are stored, and the input data ID indicates a gray level at which the offset data OD are not stored, the data converting unit 420*a* may generate the gamma corrected data GCD corresponding to the input data ID by performing gray interpolation and position interpolation using the gray interpolation unit 422*a* and the position interpolation unit 424*a*.

For example, as illustrated in FIG. 10, in a case where the data converting unit 420*a* (FIG. 7) receives the input data ID for a pixel PX for which neither the reference gamma data RGD nor the offset data OD are stored, and the input data ID indicates a gray level GLX at which the offset data OD are not stored, the position interpolation unit 424*a* may generate first and second gamma corrected data for the pixel PX at first and second gray levels GL1 and GL2 by linearly interpolating gamma corrected data for pixels P1, P2, P3 and P4 for which the reference gamma data RGD or the offset data OD are stored at the first and second gray levels GL1 and GL2. The gray interpolation unit 422*a* may generate the gamma corrected data GCD corresponding to the input data ID by linearly interpolating the first and second gamma corrected data at the first and second gray levels GL1 and GL2. As described above, the data converting unit 420*a* may convert the input data ID for the pixel PX into the gamma corrected data GCD by performing the position interpolation and then by performing the gray interpolation.

In other examples, as illustrated in FIG. 11, the data converting unit 420*a* may convert the input data ID for the pixel PX into the gamma corrected data GCD by performing the gray interpolation and then by performing the position interpolation. The gray interpolation unit 422*a* may calculate gamma corrected data for pixels P1, P2, P3 and P4 for which the reference gamma data RGD or the offset data OD are stored at a gray level GLX at which the offset data OD are not stored by performing the gray interpolation on gamma corrected data for the pixels P1, P2, P3 and P4 at gray levels GL1 and GL2 at which the offset data OD are stored. Then, the position interpolation unit 424*a* may generate the gamma corrected data GCD corresponding to the input data ID of the pixel PX by performing the position interpolation on the gamma corrected data for the pixels P1, P2, P3 and P4 at the gray level GLX.

Figure 12:
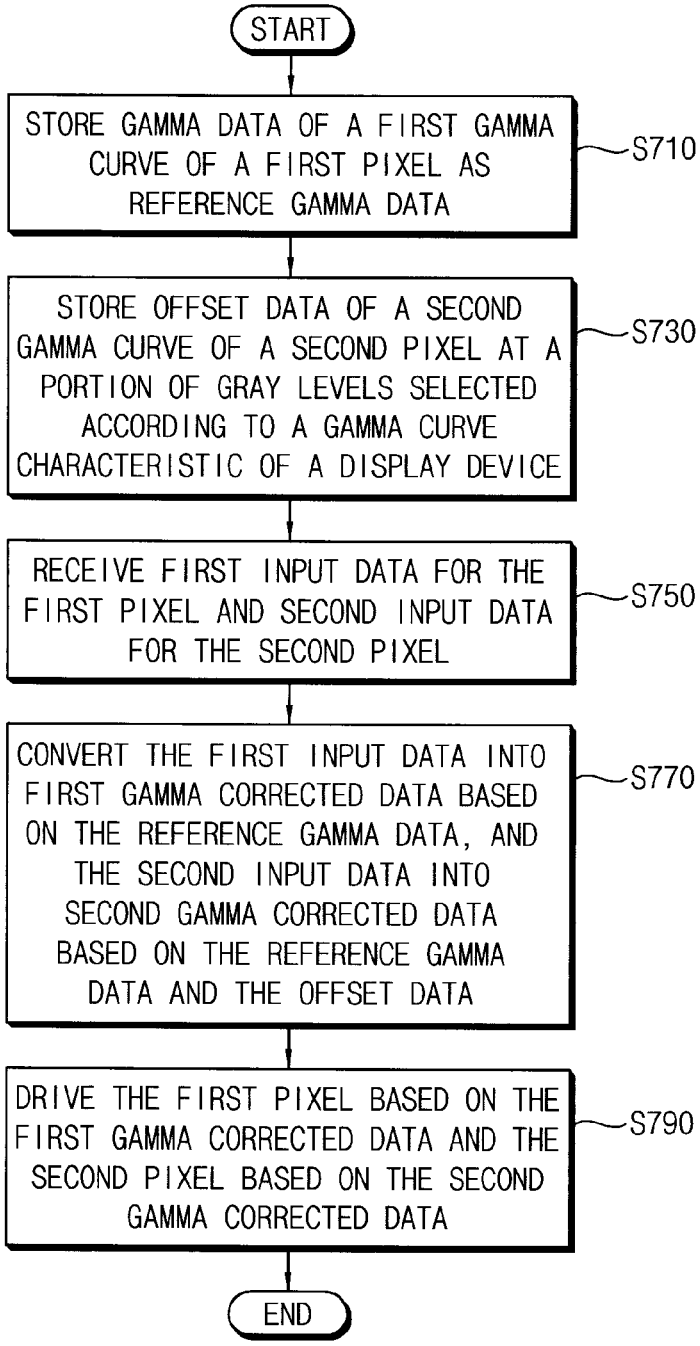
FIG. 12 is a flowchart illustrating a method of operating a display device in accordance with example embodiments.

FIG. 12 is a flowchart illustrating a method of operating a display device in accordance with example embodiments.

Referring to FIGS. 6 and 12, a gamma table 430 stores gamma data of a first curve of a first pixel at a plurality of gray levels as reference gamma data RGD (S710). Further, the gamma table 430 stores offset data corresponding to differences between gamma data of a second curve of a second pixel and the reference gamma data RGD at a portion of the plurality of gray levels that are selected according to a gamma curve characteristic of a display device 400 (S730).

A data converting unit 420 receives first input data ID for the first pixel and second input data ID for the second pixel (S750), converts the first input data ID for the first pixel into first gamma corrected data GCD based on the reference gamma data RGD, and converts the second input data ID for the second pixel into second gamma corrected data GCD based on the reference gamma data RGD and the offset data OD (S770).

A driving unit 440 drives the first pixel based on the first gamma corrected data GCD, and drives the second pixel based on the second gamma corrected data GCD (S790).

In a method of operating the display device 400 according to example embodiments, gamma data information of a plurality of positions is stored using a small sized gamma table 430 by storing the offset data OD for at least one gamma curve of at least one pixel. Further, in the method of operating the display device 400 according to example embodiments, since gray levels at which the offset data OD are stored are selected according to the gamma curve characteristic of each display device 400, a gamma curve unique to each display device 400 can be accurately recovered.

Figure 13:
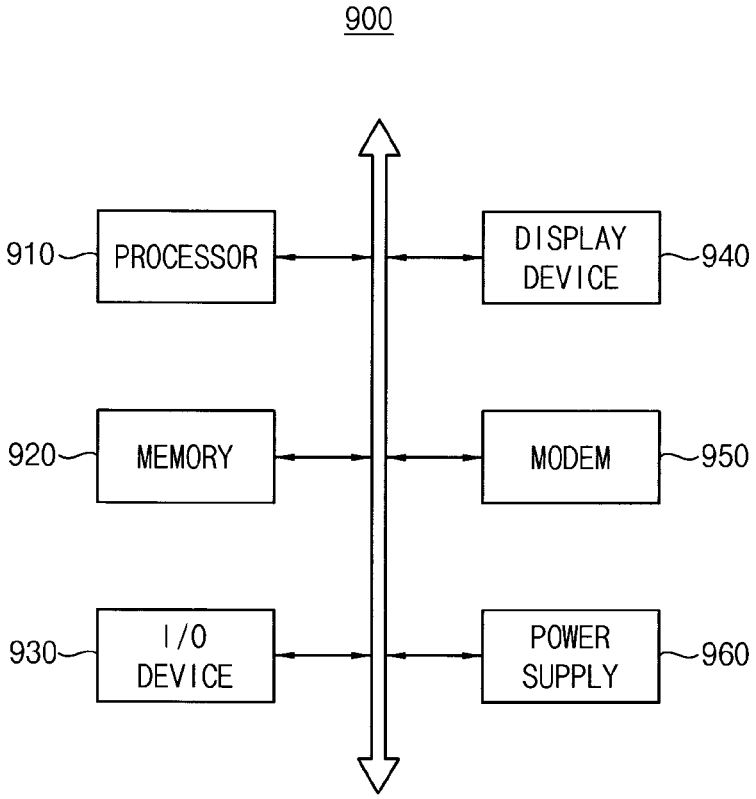
FIG. 13 is a block diagram illustrating a computing system including a display device in accordance with example embodiments.

FIG. 13 is a block diagram illustrating a computing system including a display device in accordance with example embodiments.

Referring to FIG. 13, a computing system 900 includes a processor 910 and a display device 940. In some example embodiments, the computing system 900 further includes a memory device 920, an input/output device 930, a modem 950 and a power supply 960.

The processor 910 performs specific calculations or tasks. For example, the processor 910 may be a mobile system-on-chip (SOC), an application processor, a media processor, a microprocessor, a central process unit (CPU), a digital signal processor, or the like. The processor 910 may be coupled to the memory device 920 via an address bus, a control bus and/or a data bus. For example, the memory device 920 may be implemented by a dynamic random access memory (DRAM), a mobile DRAM, a static random access memory (SRAM), a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc. Further, the processor 910 may be coupled to an extension bus, such as a peripheral component interconnect (PCI) bus. The processor 910 may control the input/output device 930 including an input device, such as a keyboard, a mouse, a keypad, etc., and an output device, such as a printer, a speaker, etc. via the extension bus. The processor 910 may be further coupled to the display device 940. The display device 940 may store offset data for at least one gamma curve, and thus may store gamma data information for a plurality of positions using a small sized gamma table. Further, in the display device 940, gray levels at which the offset data are stored may be selected according to a gamma curve characteristic of each display device 940, and thus a gamma curve unique to each display device 940 may be accurately recovered.

Further, the processor 910 may control a storage device, such as a solid state drive, a hard disk drive, a CD-ROM, etc. via the extension bus. The modem 950 may perform wired or wireless communications with an external device. The power supply 960 may supply power to the computing system 500. In some example embodiments, the computing system 900 may further include an application chipset, a camera image processor (CIS), etc.

According to example embodiments, the computing system 900 may be any suitable computing system including the display device 940, such as a digital television (TV), a 3D TV, a personal computer (PC), a home appliance, a laptop computer, a tablet computer, a mobile phone, a smart phone, a personal digital assistant (PDA), a portable multimedia player (PMP), a digital camera, a music player, a portable game console, a navigation device, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A method of operating a display device, the method comprising:

providing a plurality of gamma curves for a plurality of pixels;

storing one of the gamma curves as a reference gamma curve in a gamma table included in the display device;

selecting, among a plurality of gray levels, a portion of the gray levels for storing offset data from the reference gamma curve, the portion of gray levels selected corresponding to inflection points of a gamma curve characteristic of the display device;

with respect to at least one of the gamma curves, storing differences between the at least one gamma curve and the reference gamma curve at the selected portion of gray levels in the gamma table; and driving the plurality of pixels based on the stored difference.

2. The method of claim 1, wherein selecting the portion of gray levels comprises:

selecting the portion of gray levels based on inflection points of the reference gamma curve.

3. The method of claim 1, selecting the portion of gray levels comprises:

selecting the portion of gray levels based on a change in slope of the reference gamma curve.

4. The method of claim 1, wherein the at least one gamma curve includes a first gamma curve and a second gamma curve, and wherein selecting the portion of gray levels comprises:

selecting, among the gray levels, first gray levels for the first gamma curve based on inflection points of the first gamma curve or a change in slope of the first gamma curve; and selecting, among the gray levels, second gray levels for the second gamma curve based on inflection points of the second gamma curve or a change in slope of the second gamma curve.

5. The method of claim 4, wherein storing the differences between the at least one gamma curve and the reference gamma curve comprises:

with respect to the first gamma curve, storing differences between the first gamma curve and the reference gamma curve at the first gray levels; and with respect to the second gamma curve, storing differences between the second gamma curve and the reference gamma curve at the second gray levels.

6. The method of claim 1, wherein storing the at least one gamma curve as the reference gamma curve comprises:

storing a gamma curve of a pixel located at a center of a display panel as the reference gamma curve.

7. The method of claim 1, wherein storing the at least one gamma curve as the reference gamma curve comprises:

storing a middle gamma curve of the gamma curves as the reference gamma curve.

8. A display device, comprising:

a display panel including a plurality of pixels, the pixels including a first pixel having a first gamma curve and a second pixel having a second gamma curve;

a gamma table configured to store gamma data of the first gamma curve at a plurality of gray levels as reference gamma data, and to store offset data corresponding to differences between gamma data of the second gamma curve and the reference gamma data at a portion of the gray levels, the portion of gray levels being selected corresponding to inflection points of a gamma curve characteristic of the display device;

a data converting unit configured to convert first input data for the first pixel into first gamma corrected data based on the reference gamma data, and to convert second input data for the second pixel into second gamma corrected data based on the reference gamma data and the offset data; and a driving unit configured to drive the first pixel based on the first gamma corrected data, and to drive the second pixel based on the second gamma corrected data.

9. The display device of claim 8, wherein the portion of gray levels is selected based on inflection points of the first gamma curve.

10. The display device of claim 8, wherein the portion of gray levels is selected based on a change in slope of the first gamma curve.

11. The display device of claim 8, wherein the portion of gray levels is selected based on inflection points of the second gamma curve.

12. The display device of claim 8, wherein the portion of gray levels is selected based on a change in slope of the second gamma curve.

13. The display device of claim 8, wherein, when the second input data indicates one gray level of the portion of gray levels, the data converting unit generates the second gamma corrected data by calculating a sum of the reference gamma data and the offset data at the one gray level.

14. The display device of claim 8, wherein, when the second input data indicates one gray level other than the portion of gray levels, the data converting unit generates the second gamma corrected data by linearly interpolating sums of the reference gamma data and the offset data at the portion of gray levels.

15. The display device of claim 8, wherein, when third input data for a third pixel is received, the data converting unit generates third gamma corrected data for the third pixel by linearly interpolating the first and second gamma corrected data according to a position of the third pixel.

16. A method of operating a display device, the method comprising:

storing gamma data of a first gamma curve of a first pixel at a plurality of gray levels as reference gamma data;

storing offset data corresponding to differences between gamma data of a second gamma curve of a second pixel and the reference gamma data at a portion of the gray levels, the portion of gray levels being selected corresponding to inflection points of a gamma curve characteristic of the display device;

converting first input data for the first pixel into first gamma corrected data based on the reference gamma data;

converting second input data for the second pixel into second gamma corrected data based on the reference gamma data and the offset data; and driving the first pixel and the second pixel based on the first gamma corrected data and the second gamma corrected data, respectively.

17. The method of claim 16, wherein the portion of gray levels is selected based on inflection points of the first gamma curve or a change in slope of the first gamma curve.

18. The method of claim 16, wherein the portion of gray levels is selected based on inflection points of the second gamma curve or a change in slope of the second gamma curve.

19. The method of claim 16, wherein converting the second input data into second gamma corrected data comprises:

when the second input data indicates one gray level of the portion of gray levels, generating the second gamma corrected data by calculating a sum of the reference gamma data and the offset data at the one gray level.

20. The method of claim 16, wherein converting the second input data into second gamma corrected data comprises:

when the second input data indicates one gray level other than the portion of gray levels, generating the second gamma corrected data by linearly interpolating sums of the reference gamma data and the offset data at the portion of gray levels.

* * * * *